US011088444B2

(12) United States Patent
Sakai et al.

(10) Patent No.: US 11,088,444 B2
(45) Date of Patent: Aug. 10, 2021

(54) ANTENNA DEVICE

(71) Applicant: DENSO CORPORATION, Kariya (JP)

(72) Inventors: Toshiya Sakai, Nisshin (JP); Kazumasa Sakurai, Nisshin (JP); Asahi Kondo, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/794,695

(22) Filed: Feb. 19, 2020

(65) Prior Publication Data

US 2020/0185824 A1 Jun. 11, 2020

Related U.S. Application Data

(63) Continuation of application No. PCT/JP2018/030557, filed on Aug. 17, 2018.

(30) Foreign Application Priority Data

Aug. 21, 2017 (JP) ..... JP2017-158689

(51) Int. Cl.
*H01Q 1/52* (2006.01)
*H01Q 1/32* (2006.01)
(Continued)

(52) U.S. Cl.
CPC ..... *H01Q 1/52* (2013.01); *H01Q 1/3233* (2013.01); *H01Q 1/3283* (2013.01); *H01Q 15/24* (2013.01); *H01Q 21/065* (2013.01)

(58) Field of Classification Search
CPC ..... H01Q 1/28; H01Q 1/32; H01Q 1/3233; H01Q 1/3208; H01Q 1/325; H01Q 1/3283;
(Continued)

(56) References Cited

U.S. PATENT DOCUMENTS

2012/0299797 A1* 11/2012 Murdock ..... H01Q 1/52 343/893
2016/0020648 A1* 1/2016 Contopanagos ..... H01Q 19/10 307/104
(Continued)

FOREIGN PATENT DOCUMENTS

JP 2014-045378 A 3/2014
JP 2017-112460 A 6/2017
JP 2018-186482 A 11/2018

OTHER PUBLICATIONS

N. Rao and Dinesh Kumar V., "Gain enhancement of microstrip patch antenna for Wi-Fi applications," 2014 Loughborough Antennas and Propagation Conference (LAPC), Loughborough, UK, 2014, pp. 312-315 (Year: 2014).*

*Primary Examiner* — Robert Karacsony
(74) *Attorney, Agent, or Firm* — Maschoff Brennan

(57) ABSTRACT

A dielectric substrate has a first surface formed with a base plate and a second surface formed with an antenna part. The antenna part has one or more antenna patterns. An additional function part has a plurality of conductor patterns arranged around the antenna part. The plurality of conductor patterns resonate in one or more resonance directions to incident waves having an operating frequency of the antenna part, thereby generating emitted waves having polarized waves different from those of electromagnetic waves transmitted/received by the antenna part. For each of the resonance directions, at least one of the conductor patterns includes at least one line pattern having a width which is narrower than the total width of the conductor patterns in the direction perpendicular to the resonance direction.

9 Claims, 12 Drawing Sheets

(51) Int. Cl.
*H01Q 15/24* (2006.01)
*H01Q 21/06* (2006.01)

(58) Field of Classification Search
CPC ..... H01Q 1/52; H01Q 3/44; H01Q 3/446; H01Q 3/46; H01Q 15/0006; H01Q 15/0013; H01Q 15/0026; H01Q 15/006; H01Q 15/008; H01Q 15/0086; H01Q 15/0093; H01Q 21/06; H01Q 21/061; H01Q 21/065; G01S 13/93; G01S 13/931; G01S 13/933
See application file for complete search history.

(56) References Cited

U.S. PATENT DOCUMENTS

| | | | | |
|---|---|---|---|---|
| 2017/0179586 | A1* | 6/2017 | Meyer ..... | H01Q 21/245 |
| 2018/0366818 | A1* | 12/2018 | Kawaguchi ..... | H01Q 21/065 |

* cited by examiner

ANTENNA DEVICE

CROSS-REFERENCE TO RELATED APPLICATION

The present application is a continuation application of International Application No. PCT/JP2018/030557, filed Aug. 17, 2018, which claims priority to Japanese Patent Application No. 2017-158689, filed Aug. 21, 2017. The contents of these applications are incorporated herein by reference in their entirety.

BACKGROUND

1. Technical Field

The present disclosure relates to an antenna device.

2. Related Art

An antenna formed on a dielectric substrate is used, for example, in a radar for monitoring the area around a moving object such as a vehicle or an aircraft, which is provided therein. When the antenna of this type is used as an antenna for an on-board radar device, it is conceivable that the antenna will be mounted, for example, within the bumper of a vehicle. In this case, it is known that a part of the electromagnetic waves radiated from the antenna may be reflected at the inner wall of the bumper and further re-reflected on the radiation surface of the antenna, and that the re-reflected waves interfere with the radiated waves to adversely affect the antenna directive.

SUMMARY

The present disclosure provides an antenna device. An antenna device according to one mode of the present disclosure includes a dielectric substrate, a base plate, an antenna part, and an additional function part. The dielectric substrate has a first surface formed with the base plate and a second surface formed with the antenna part. The antenna part has one or more antenna patterns. The additional function part has a plurality of conductor patterns arranged around the antenna part. The plurality of conductor patterns resonate in one or more resonance directions to incident waves having an operating frequency of the antenna part, thereby generating emitted waves having polarized waves different from those of electromagnetic waves transmitted/received by the antenna part. For each of the resonance directions, at least one of the conductor patterns includes at least one line pattern having a width which is narrower than the total width of the conductor patterns in the direction perpendicular to the resonance direction.

DETAILED DESCRIPTION OF THE PREFERRED EMBODIMENTS

Figure 1:
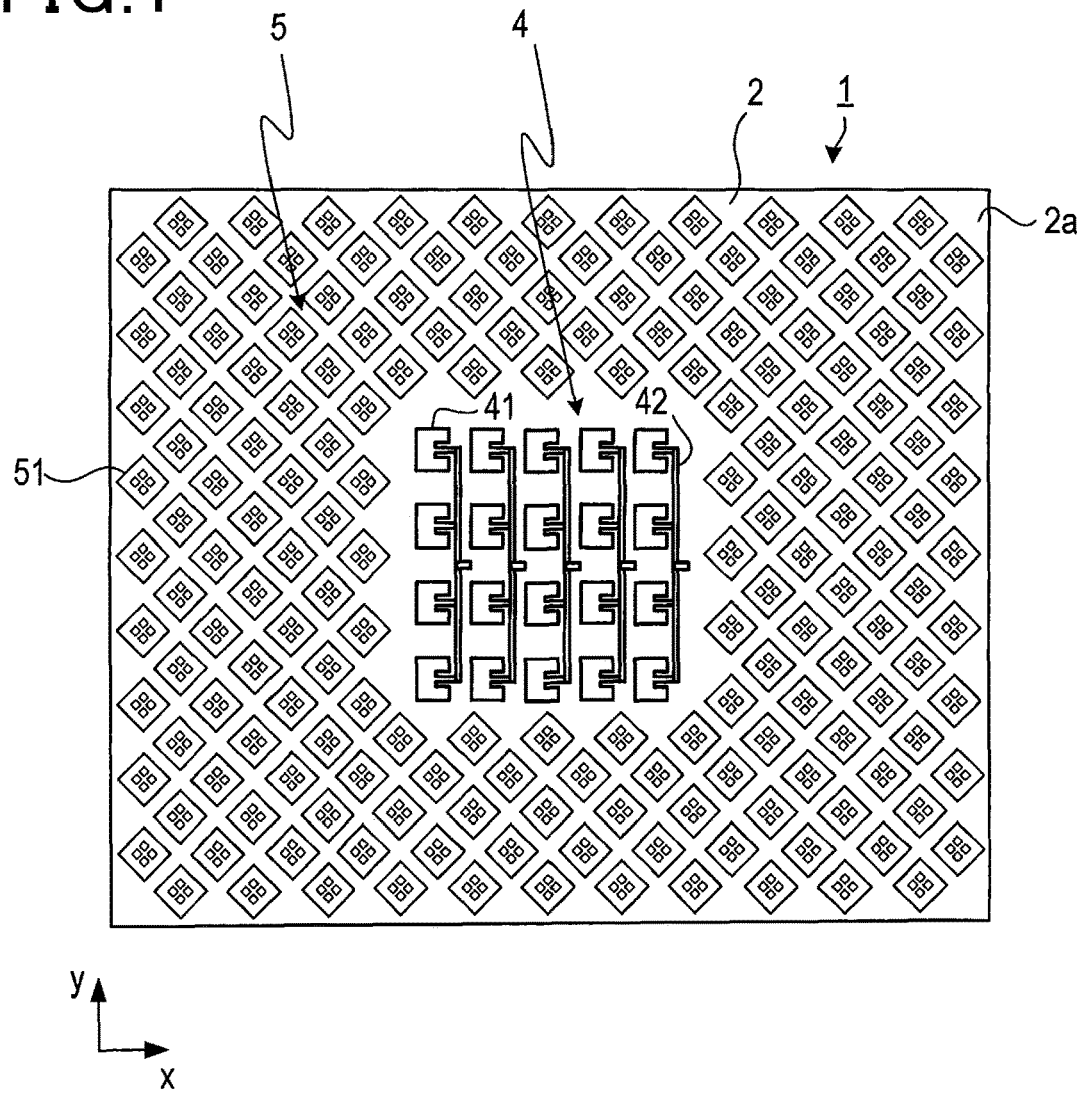
FIG. 1 is a plan view showing the configuration of an antenna device.

The inventors of the present disclosure have studied the following technique for suppressing the disturbance of the antenna directive caused by reflected waves and manufacturing variations.

For example, JP 2014-45378 A (hereinafter referred to as "PTL 1") discloses a technique of gradually changing the patch size to tilt the reflected wave phase surface in a flat substrate structure composed of many conductor patterns arranged adjacent to each other and vias that ground the respective conductor patterns, thereby suppressing the disturbance of the antenna directive.

However, as a result of the inventor's detailed study, the related art described in PTL 1 has been found to involve the problem that, since the reflection direction is merely changed while the total quantity of the reflected waves is unchanged, the influence of the interference between the radiated waves and the reflected waves occurs in another direction.

Further, the related art has been found to involve the problem that the desired antenna directive may not be realized as the entire antenna due to changes in characteristics of the individual patches caused by variations during etching process of the conductor patterns, i.e., overetching or underetching.

One aspect of the present disclosure resides in providing a technique for suppressing the disturbance of the antenna directive caused by reflected waves and manufacturing variations.

An antenna device according to one mode of the present disclosure includes a dielectric substrate, a base plate, an antenna part, and an additional function part.

The base plate is formed on a first surface of the dielectric substrate and acts as an antenna ground contact surface. The antenna part is formed on a second surface of the dielectric substrate and has one or more antenna patterns configured to act as radiating elements. The additional function part has a plurality of conductor patterns arranged around the antenna part. The plurality of conductor patterns resonate in one or more resonance directions to incident waves having an operating frequency of the antenna part, thereby generating emitted waves having polarized waves different from those of transmitted/received waves which are electromagnetic waves transmitted/received by the antenna part. For each of the resonance directions, at least one of the conductor patterns is formed in a specific shape which is provided with at least one line pattern having a width which is narrower than the total width of the conductor patterns in the direction perpendicular to the resonance direction.

According to such a configuration, the incident waves on the additional function part are converted to emitted waves having polarized waves different from those of the electromagnetic waves transmitted/received by the antenna part, by the conductor patterns belonging to the additional function part. Namely, due to the difference in polarized waves between the radiated waves from the antenna part and the emitted waves from the additional function part, the interference therebetween is suppressed, with the result that the disturbance of the antenna directive can be suppressed.

Also, the conductor pattern having a specific shape has a line pattern, so that the increases/decreases of inductance components of the conductor patterns and capacitance components between the conductor patterns change in a manner opposite to each other in either case of overetching and underetching. As a result, it is possible to suppress changes in characteristics of the additional function part due to the manufacturing variations and, therefore, to effectively suppress the disturbance of the antenna directive.

Reference numbers in parentheses in the claims indicate correspondences with specific means according to an embodiment which will be described as a mode below, and do not limit the technical scope of the present disclosure.

Hereinafter, an embodiment of the present disclosure will be described with reference to the drawings.

[1. Configuration]

An antenna device 1 is used in a millimeter wave radar for detecting various targets which are present on the area around a vehicle. The antenna device 1 is arranged, for example, within the bumper of the vehicle.

Figure 2:
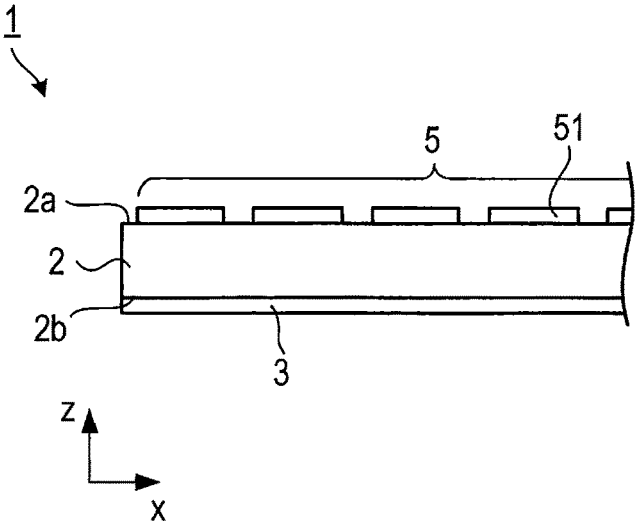
FIG. 2 is a front view showing the configuration of the antenna device.

The antenna device 1 has a rectangular dielectric substrate 2 as shown in FIGS. 1 and 2. Hereinafter, a first surface of the dielectric substrate 2 is referred to as substrate front surface 2*a*, and a second surface thereof is referred to as substrate rear surface 2*b*. Further, the direction along a first side of the dielectric substrate 2 is referred to as x-axis direction, the direction along a second side perpendicular to the x-axis direction is referred to as y-axis direction, and the normal direction of the substrate front surface 2*a* is referred to as z-axis direction.

The substrate rear surface 2*b* is provided with a base plate 3 that functions as a ground contact surface. The base plate 3 is a copper pattern covering the entire surface of the substrate rear surface 2*b*. The substrate front surface 2*a* is provided with an antenna part 4 near its center. Also, an additional function part 5 is provided around the antenna part 4.

The antenna part 4 includes a plurality of array antennas aligned along the x-axis direction. Each of the array antennas includes a plurality of patch antennas 41 arranged along the y-axis direction and feeder lines 42 that supply power to the respective patch antennas 41. Each of the patch antennas 41 is a rectangular copper pattern and arranged in such a manner that each of the sides is along the x-axis or the y-axis. The feeder lines 42 are connected to the respective patch antennas 41 so that the polarization direction of the electromagnetic waves radiated from the antenna part 4 coincides with the x-axis direction.

Figure 3:
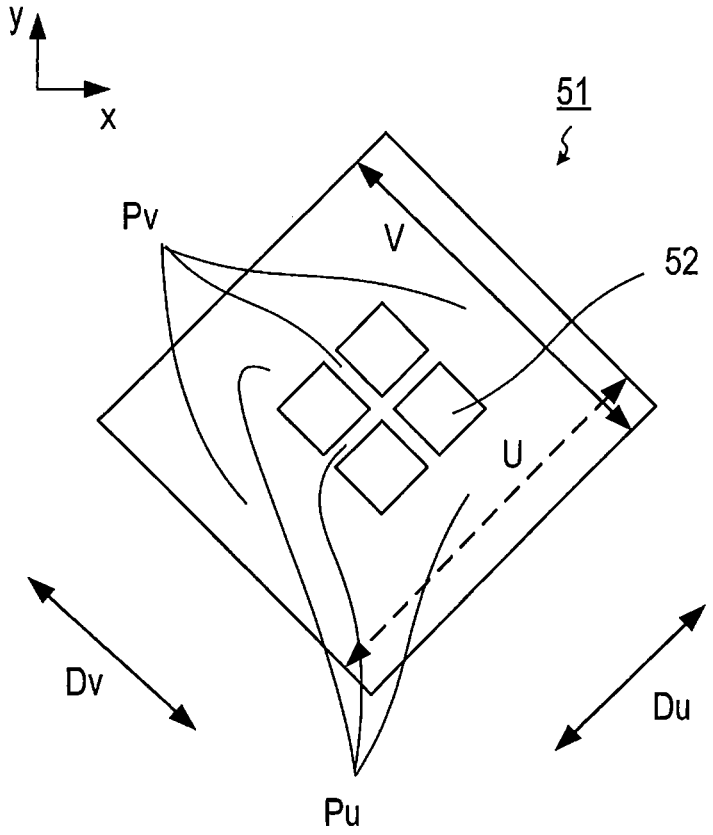
FIG. 3 is a plan view showing the configuration of a conductor pattern belonging to an additional function part.

The additional function part 5 has a plurality of conductor patterns 51 arranged two-dimensionally. The conductor patterns 51 are copper patterns having a rectangular outer shape and have a plurality of pattern-removed regions 52 therein, as shown in FIG. 3. Here, the direction along a first side (hereinafter, long side) which is one side of each of the conductor patterns 51 is referred to as first resonance direction Du, and the direction along a second side (hereinafter, short side) perpendicular to the first side is referred to as second resonance direction Dv. The plurality of pattern-removed regions 52 are all formed in a rectangular shape. The respective pattern-removed regions 52 are arranged in such a manner that each of the sides forming the outer shape is parallel to either the long sides or the short sides of the conductor patterns 51. The pattern-removed regions 52 are formed so as to be aligned in such a manner that they are spaced apart from each other. Thus, a plurality of line patterns Pu along the first resonance direction Du and a plurality of line patterns Pv along the second resonance direction Dv are formed between the respective pattern-removed regions 52 and between the long sides or the short sides of the respective pattern-removed regions 52 and the conductor patterns 51.

The plurality of line patterns Pu are all narrower than the width V of the conductor patterns 51 (i.e., size of the short sides) in a direction perpendicular to the first resonance direction Du. That is, a width of the line pattern Pu is narrower than the width V of the conductor pattern 51. Similarly, the plurality of line patterns Pv are all narrower than the width U of the conductor patterns 51 (i.e., size of the long sides) in a direction perpendicular to the second resonance direction Dv. That is, a width of the line pattern Pv is narrower than the width U of the conductor pattern 51.

The conductor patterns 51 are arranged in such a manner that the directions along the long sides and the short sides, i.e., the first resonance direction Du and the second resonance direction Dv, both incline 45° to the x-axis. The incident waves from the external onto the conductor patterns 51 resonate in the first resonance direction Du and the second resonance direction Dv, respectively, in the conductor patterns 51. As the incident waves from the external, surface waves propagated from the antenna part 4 are also conceivable, in addition to the reflected waves radiated from the antenna part 4 and reflected, for example, by the bumper. The size U of the long sides and the size V of the short sides of the conductor patterns 51 are set so that the phase differences between the phases when the waves resonate at the respective sides (hereinafter, phase differences at the time of resonance) are opposite to each other, i.e., the phases are different by 180°.

[2. Design]

Here, methods for designing the sizes U and V of the respective sides of the conductor patterns 51 will be described.

Figure 4:
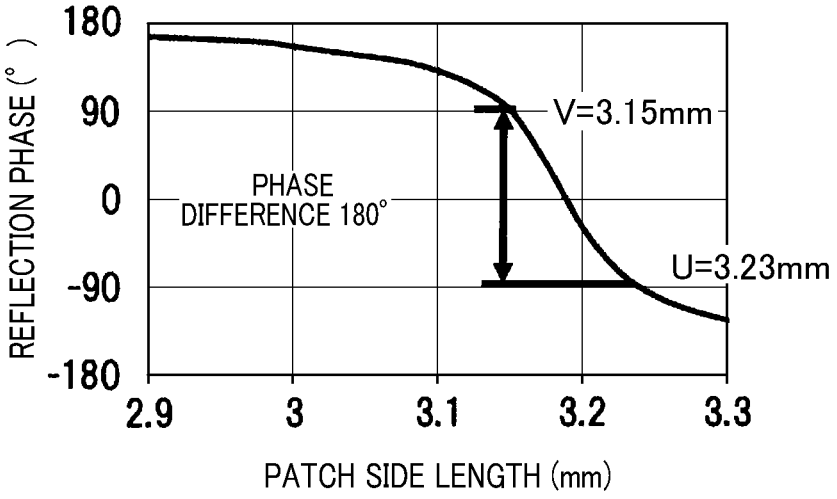
FIG. 4 is a graph showing the relationship between the length of sides of the conductor patterns and the reflection phase at the time of resonance.

FIG. 4 is a graph showing the relationship between the size of the sides of the conductor patterns 51 and the phase of the reflected waves from the conductor patterns 51 measured when plane waves are incident on the conductor patterns 51. Here, the size of the sides is varied, assuming that the frequency of the incident waves is 24.15 GHz and the respective conductor patterns are formed in a square shape. The size was obtained through simulation, assuming that the conductor patterns 51 are aligned infinitely. FIG. 4 shows the size U=3.23 mm and the size V=3.15 mm when the average size of both the sides of the respective conductor patterns 51 are made coincident with the wavelength γ at the operation frequency of the antenna device 1. However, the average size of both the sides does not necessarily have to be accurately coincident with the wavelength γ, and may be shifted by about several %.

[3. Operation]

Figure 5:
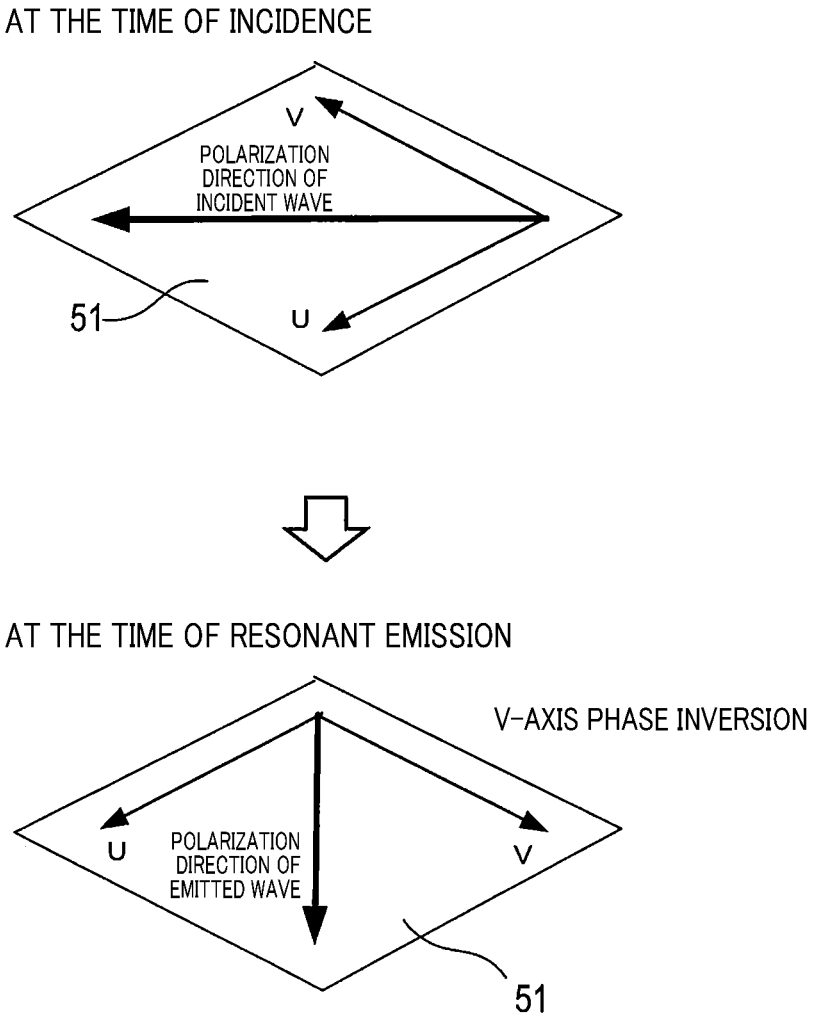
FIG. 5 is an explanatory view showing the polarization directions of an incident wave on the conductor patterns and an emitted wave from the conductor patterns.

In the thus-configured antenna device 1, the incident waves whose polarization direction is the x-axis direction, similarly to the transmitted/received waves which are transmitted/received by the antenna part 4, when being incident on the conductor patterns 51, resonate at the long sides (i.e., the first resonance direction Du) and the short sides (i.e., the second resonance direction Dv), respectively, in the conductor patterns 51, as shown in FIG. 5. At this time, the phase differences at the time of resonance at the long sides and the short sides are opposite phases, and thus the emitted waves whose polarization direction is the y-axis direction are emitted from the conductor patterns 51.

Figure 6:
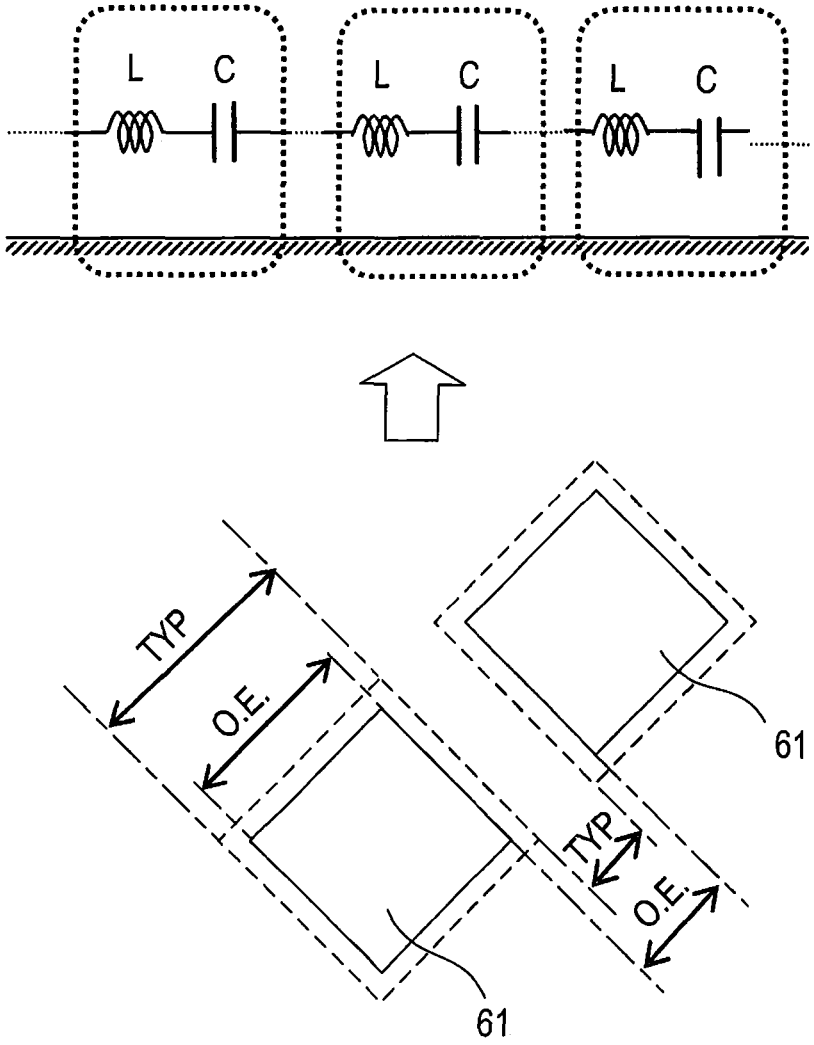
FIG. 6 is an explanatory view showing the equivalent circuit of conventional conductor patterns and the influence of variations in etching process on the conductor patterns.

Here, the actions of the line patterns Pu, Pv formed in the conductor patterns 51 will be described. A conventional device to be compared is assumed to include an additional function part constituted by conductor patterns 61 having no pattern-removed region 52. In the equivalent circuit of the additional function part in the conventional device, inductance components L that are determined depending on the shape and size of the conductor patterns 61 and capacitance components C that are determined depending on the intervals between the respective conductor patterns 61 and the width of the site where both the patterns face each other are connected in series, as shown in FIG. 6.

In the conductor patterns 61 of the conventional device, for example, when the external size of the conductor patterns 61 becomes smaller than the desired size by overetching, both of L and C decrease. When the changes in L and C are defined as ΔL and ΔC, an operation frequency f is expressed by Formula (1):

[Mathematical Formula 1]

$$f = \frac{1}{2\pi\sqrt{(L-\Delta L)\cdot(C-\Delta C)}} \tag{1}$$

In the case of underetching, the signs of symbols of ΔL and ΔC are inverted.

Figure 7:
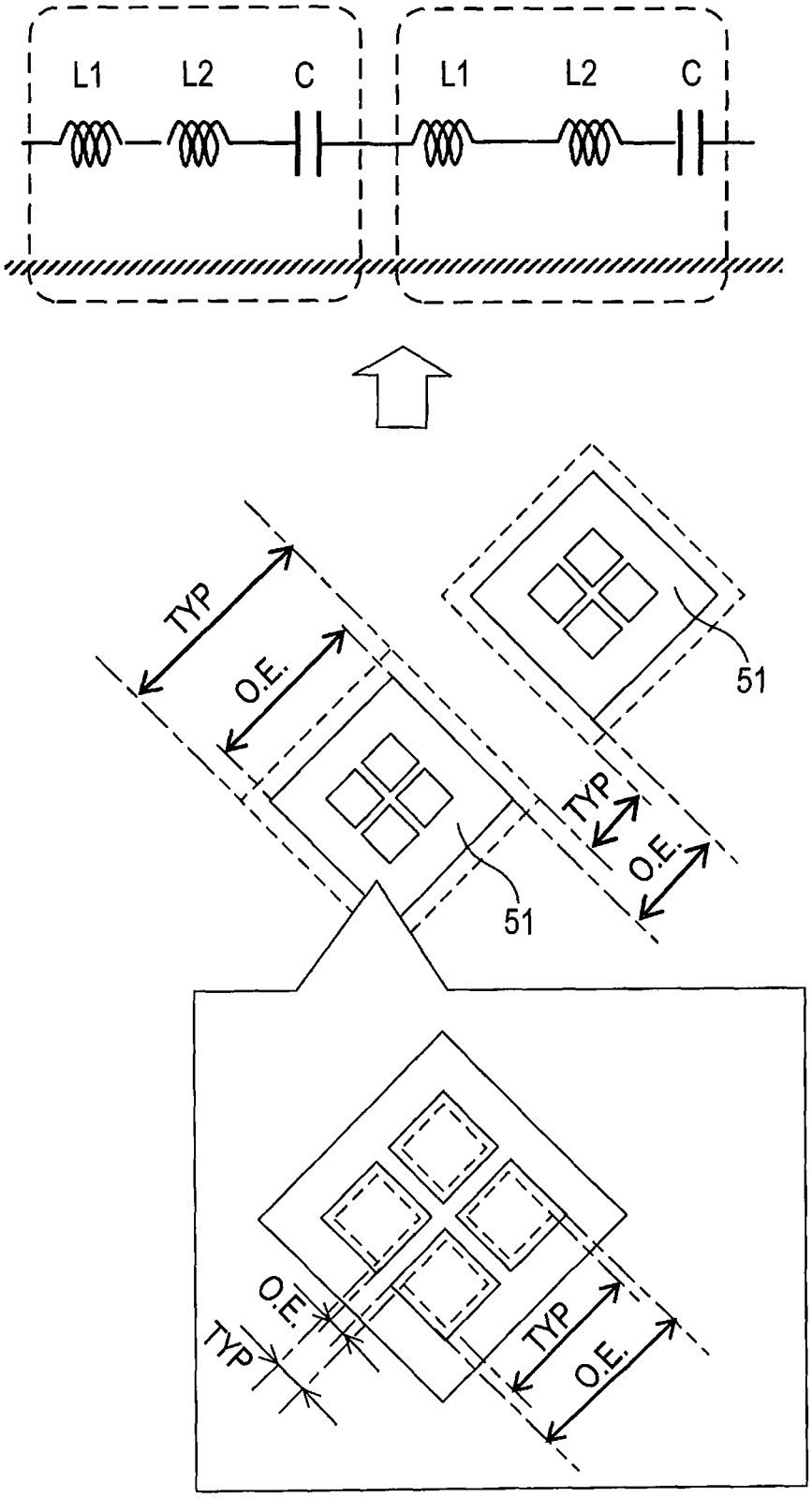
FIG. 7 is an explanatory view showing the equivalent circuit of the conductor patterns according to the present disclosure and the influence of variations in etching process on the conductor patterns.

In the equivalent circuit of the additional function part 5 in the antenna device 1, inductance components that are determined depending on the external sizes U and V of the conductor patterns 51, inductance components L2 that are determined depending on the lengths and widths of the line patterns Pu and Pv, and capacitance components C that are determined depending on the intervals between the respective conductor patterns 51 and the width of the site where both the patterns face each other are connected in series, as shown in FIG. 7.

In the conductor patterns 51 of the antenna device 1, when the external size of the conductor patterns 51 becomes smaller than the desired size by overetching, L1 and C decrease as is the case with the conventional device. However, the pattern-removed regions 52 is widened by overetching, so that the pattern lengths of the line patterns Pu and Pv increase and the pattern widths thereof decrease. So, L2 increases. When the changes in L1, L2 and C are defined as ΔL1, ΔL2 and ΔC, the operation frequency f is expressed by Formula (2):

[Mathematical Formula 2]

$$f = \frac{1}{2\pi\sqrt{(L1-\Delta L1+L2+\Delta L2)\cdot(C-\Delta C)}} \tag{2}$$

In the case of underetching, the signs of symbols of ΔL1, ΔL2 and ΔC are inverted.

Namely, in either case of overetching and underetching, the increase/decrease in L2 changes in a direction opposite to those in L1 and C, and thus acts in a direction suppressing change in the operation frequency f. It is desirable that the size of the pattern-removed regions 52 and, therefore, the sizes of the line patterns Pu and Pv be set to satisfy ΔL1<ΔL2 in consideration of the pattern tolerance at the time of manufacture, and further set so that (ΔL1−ΔL2)/(L1+L2) and ΔC/C are equivalent to each other.

[4. Effect]

The embodiment described in detail above provides the following effects.

(1) In the antenna device 1, the additional function part 5 converts the incident waves which are incident on the conductor patterns 51 to emitted waves whose polarization direction is different from that of the transmitted/received waves by the antenna part 4, and emits the waves. Therefore, the interference between the transmitted/received waves by the antenna part 4 and the emitted waves emitted by the additional function part 5 is suppressed, thereby making it possible to suppress the disturbance of the antenna directive of the antenna part 4 due to the influence of the emitted waves.

Figure 8:
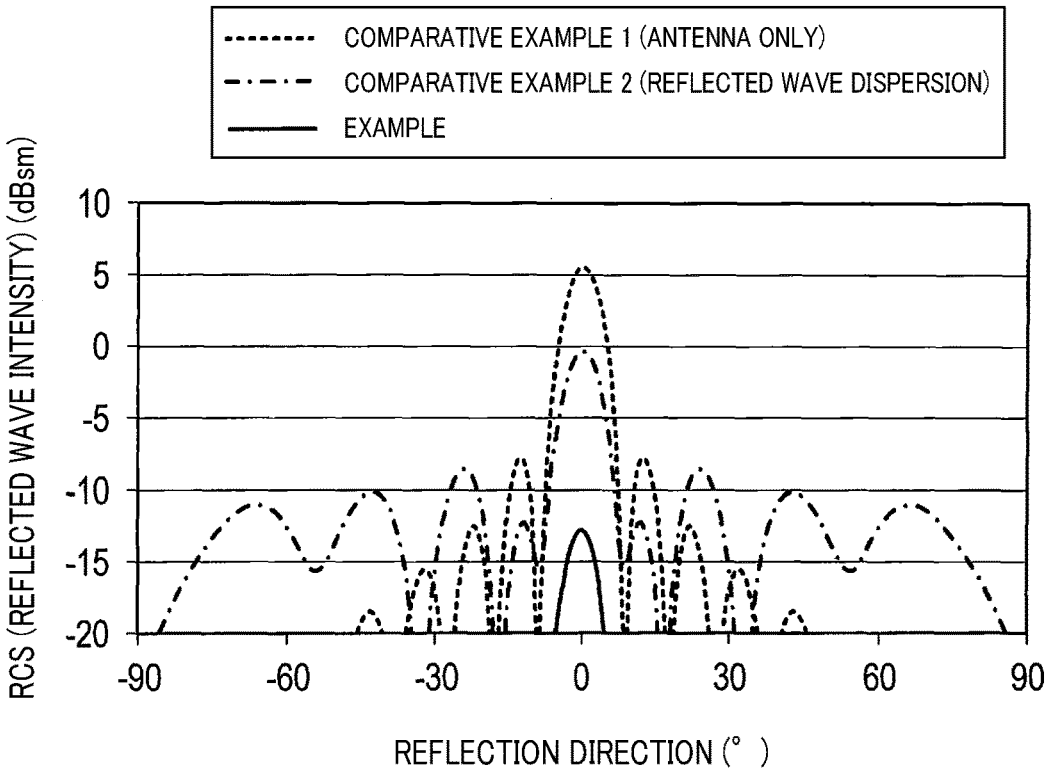
FIG. 8 is a graph showing the reflected wave intensity of the antenna device as compared with comparative examples.

FIG. 8 shows results of determination, through simulation, of the reflected wave intensity (hereinafter, RCS) when plane waves are applied, from the z-axis direction, to the substrate front surface 2*a* formed with the antenna part 4, only in terms of the polarized wave component of the electromagnetic waves transmitted/received by the antenna part 4, i.e., the component in the x-axis direction, for the antenna device 1 (i.e., Example), Comparative Example 1 and Comparative Example 2. Here, the angle of the front direction (i.e., z-axis direction) is defined as 0°, and the angles within the range of 0°±60° are defined as detection angles. Comparative Example 1 has a configuration in which the additional function part 5 has been removed from the antenna device 1, and Comparative Example 2 has an additional function part configured to change the reflection direction without changing the polarized waves to disperse the reflected waves, in place of the additional function part 5.

It can be understood that, as shown in FIG. 8, the reflected wave intensities (i.e., RCSs) in directions other than the front direction (i.e., reflection direction 0°) are suppressed, i.e., the generation of the emitted waves as the cause of interference is suppressed in the Example as compared with Comparative Examples 1 and 2.

(2) In the antenna device 1, each of the conductor patterns 51 includes the plurality of line patterns Pu and Pv formed by the plurality of pattern-removed regions 52. So, it is possible to suppress changes in frequency characteristics of the antenna due to the manufacturing variations caused during etching, i.e., underetching and overetching.

Figure 9:
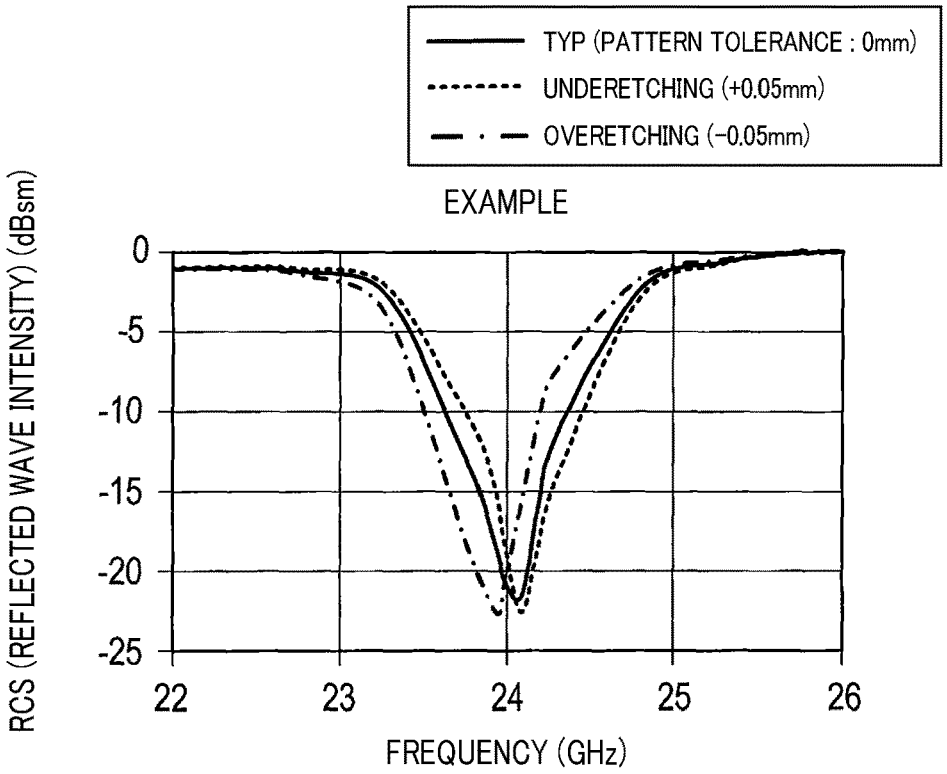
FIG. 9 is a graph showing the influence of the pattern tolerance on the operation frequency in the antenna device according to the present disclosure.
Figure 10:
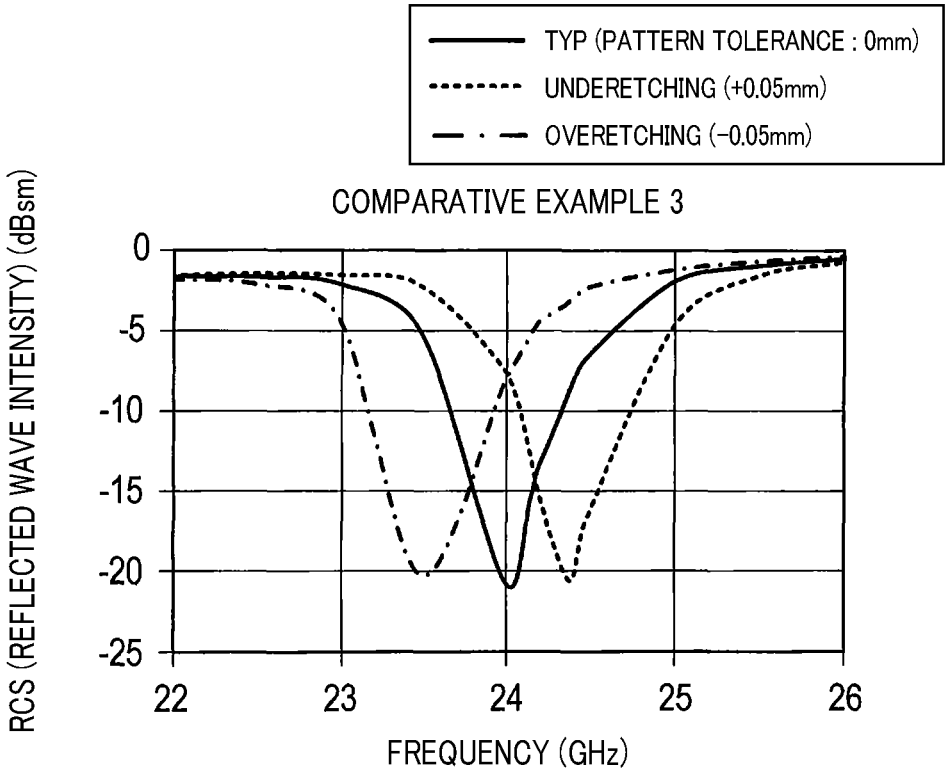
FIG. 10 is a graph showing the influence of the pattern tolerance on the operation frequency in a conventional antenna device.

FIGS. 9 and 10 show results of determination, through simulation, of the frequency characteristics of RCS by appropriately changing the pattern tolerance. Here, the antenna device 1 was designed to operate in the vicinity of 24 GHz, and simulation was performed on the cases where the pattern tolerance was 0 mm (i.e., TYP: size as designed), +0.05 mm (i.e., U.E: underetched size) and −0.05 mm (i.e., O.E: overetched size). FIG. 9 shows the case of the Example, and FIG. 10 shows the case of Comparative Example 3. Comparative Example 3 is configured similarly to the Example except that conductor patterns having no pattern-removed region 52 are used in place of the conductor patterns 51 constituting the additional function part 5.

As can be understood from FIGS. 9 and 10, RCS is minimum in the vicinity of 24 GHz and the antenna characteristics are almost unchanged, regardless of the pattern tolerance, in the Example, however the frequency at which RCS is minimum is shifted by about 24 GHz±0.5 GHz, i.e., the antenna characteristics greatly change due to the pattern tolerance in Comparative Example 3.

Figure 11:
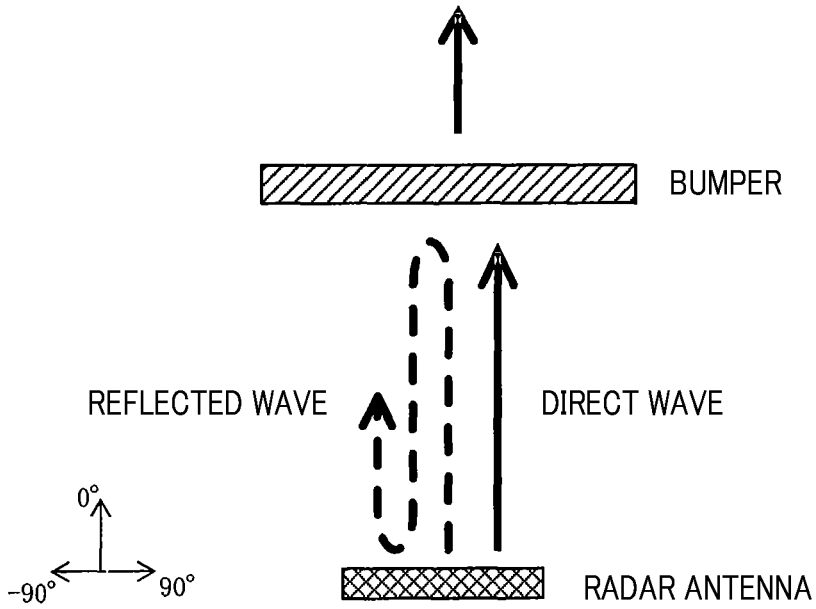
FIG. 11 is an explanatory view schematically showing the reflected wave generated by a bumper.
Figure 12:
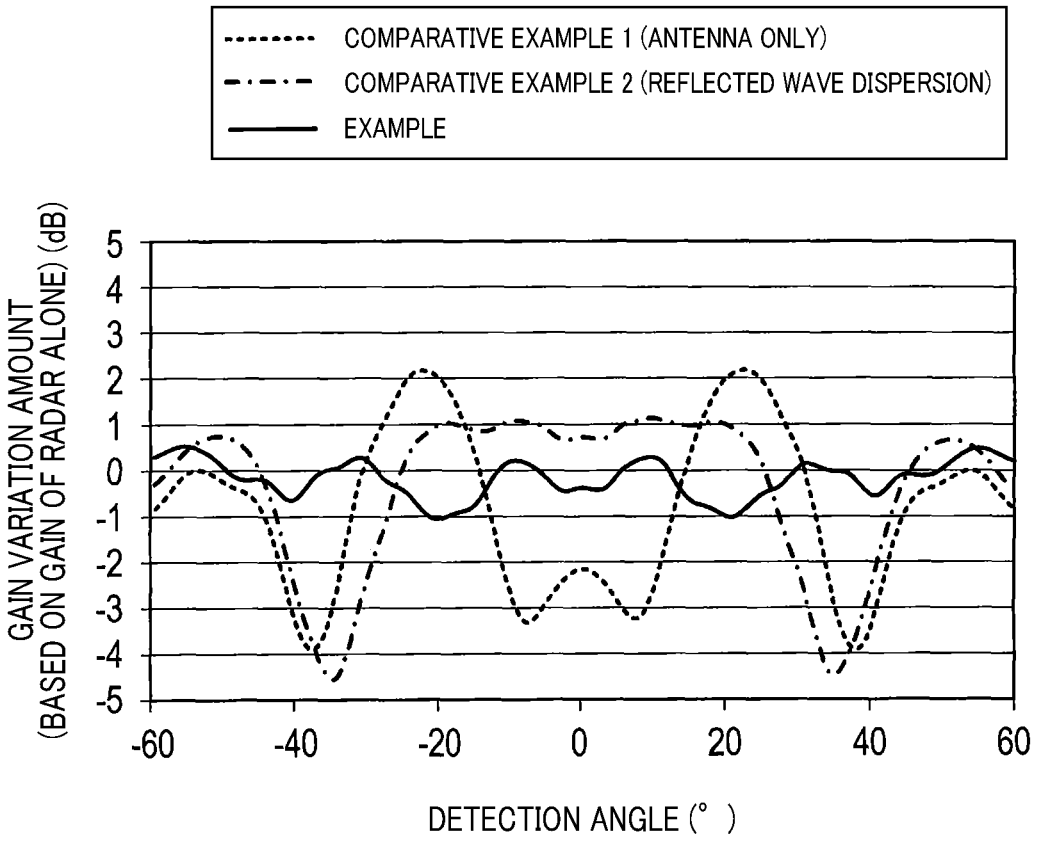
FIG. 12 is a graph showing the amount of gain variation due to the presence or absence of the bumper as compared with the comparative examples.
Figure 13:
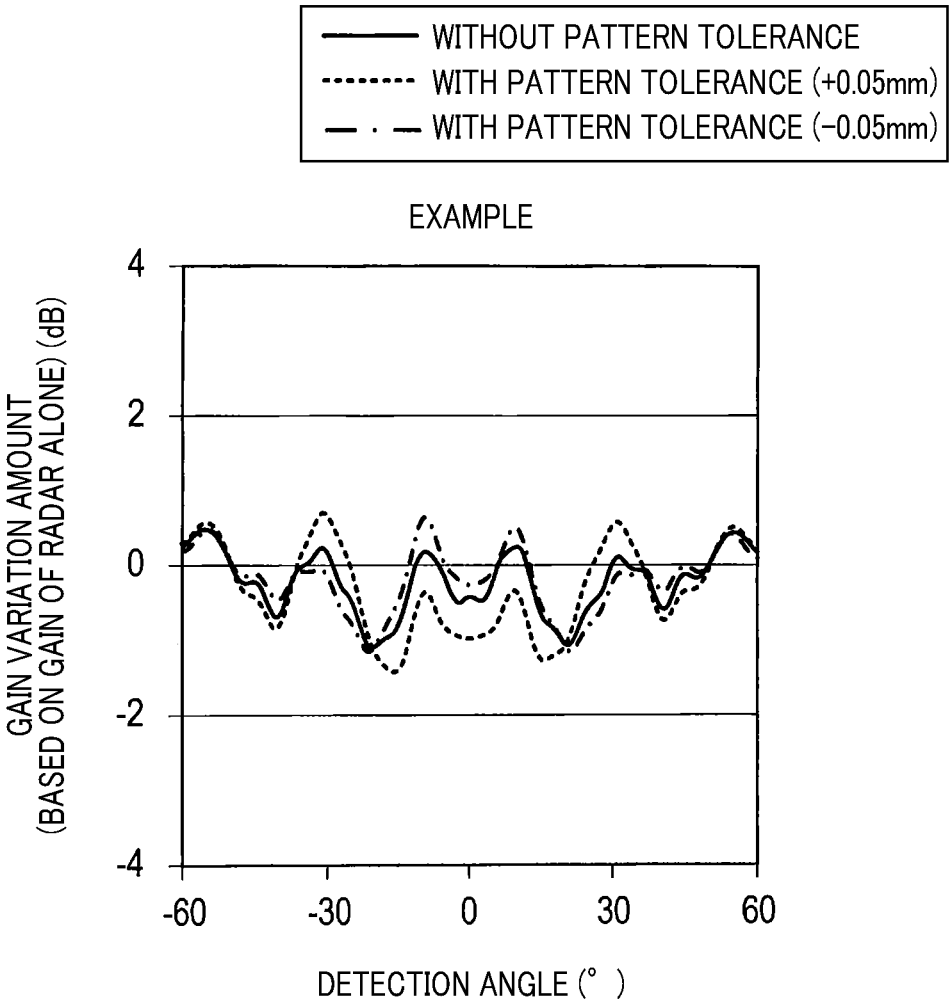
FIG. 13 is a graph showing the influence of the pattern tolerance on the gain variation amount in the antenna device according to the present disclosure.
Figure 14:
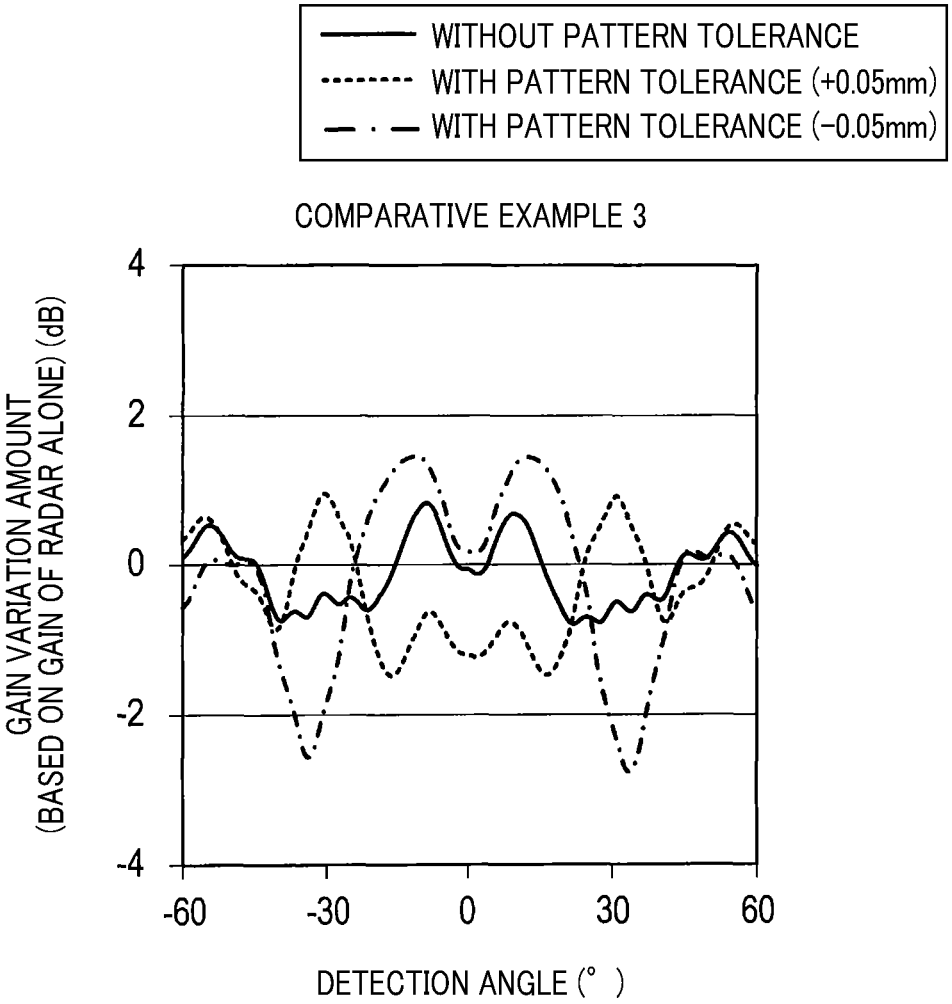
FIG. 14 is a graph showing the influence of the pattern tolerance on the gain variation amount in the conventional antenna device.

(3) FIGS. 12 to 14 show results of evaluation, through simulation, of the amount of change in gain when a dielectric flat plate simulating the bumper is placed at the antenna front, as shown in FIG. 11, based on the gain of the antenna device alone. FIG. 12 shows results of the Example as compared with results of Comparative Examples 1 and 2, similarly as in the explanation in FIG. 8. As is the case with FIGS. 9 and 10, FIG. 13 shows the cases where the pattern tolerance is 0 mm and ±0.05 mm in the Example, and FIG. 14 shows such cases in Comparative Example 3.

It can be understood that the Example shows a small gain variation amount as compared with Comparative Examples 1 and 2, as shown in FIG. 12. Further, as shown in FIGS. 13 and 14, it can be understood that, in the Example, even when the pattern tolerance is changed, the gain variation amount does not greatly change as compared with that in Comparative Example 3, and that stable antenna characteristics can be obtained regardless of the variations at the time of manufacture.

[5. Other Embodiments]

The embodiment of the present disclosure has been described above. However, the present disclosure is not limited to the above-described embodiment, and may be carried out in various modified forms.

(a) In the above-described embodiment, the shape of the pattern-removed regions 52 in the conductor patterns 51 is rectangular. However, the present disclosure is not limited to this. For example, the shape of pattern-removed regions 52*a* may be right-triangular as in a conductor pattern 51*a* shown in FIG. 15, or the shape of pattern-removed regions 52*b* may be circular or elliptical as in a conductor patterns 51*b* shown in FIG. 16.

Figure 15:
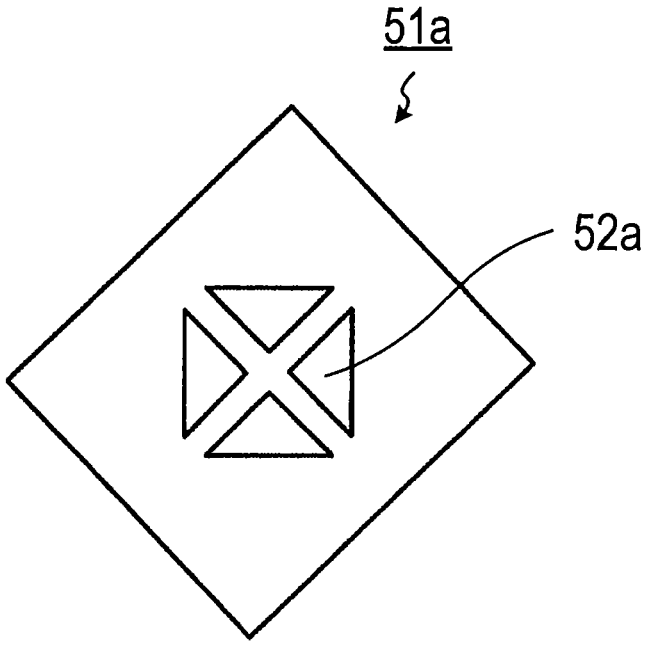
FIG. 15 is an explanatory view showing a variant of the conductor pattern.
Figure 16:
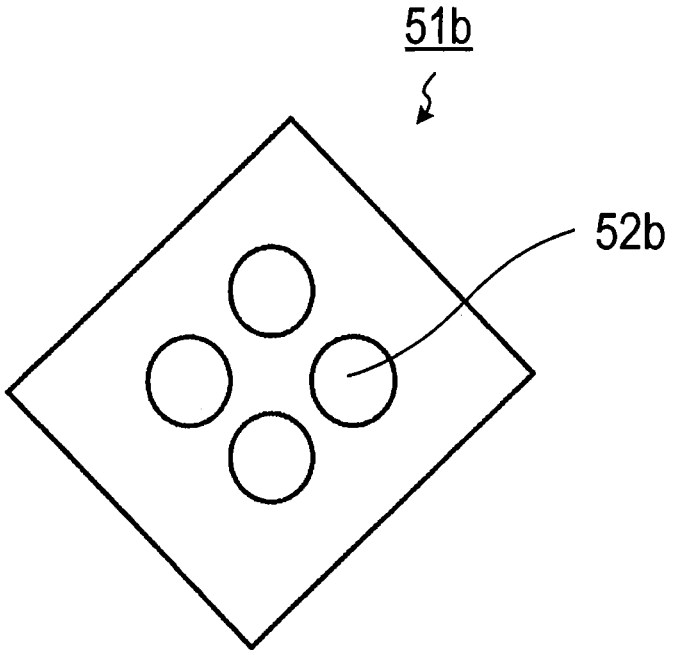
FIG. 16 is an explanatory view showing a variant of the conductor pattern.

When the shape of the pattern-removed regions 52*a* may be right-triangular as shown in FIG. 15, the two perpendicular sides of the right triangle (hereinafter, perpendicular sides) may be located along the first resonance direction Du and the second resonance direction Dv, respectively, and a line pattern having a constant width may be formed between the perpendicular sides of the adjacent pattern-removed regions 52*a*.

Figure 17:
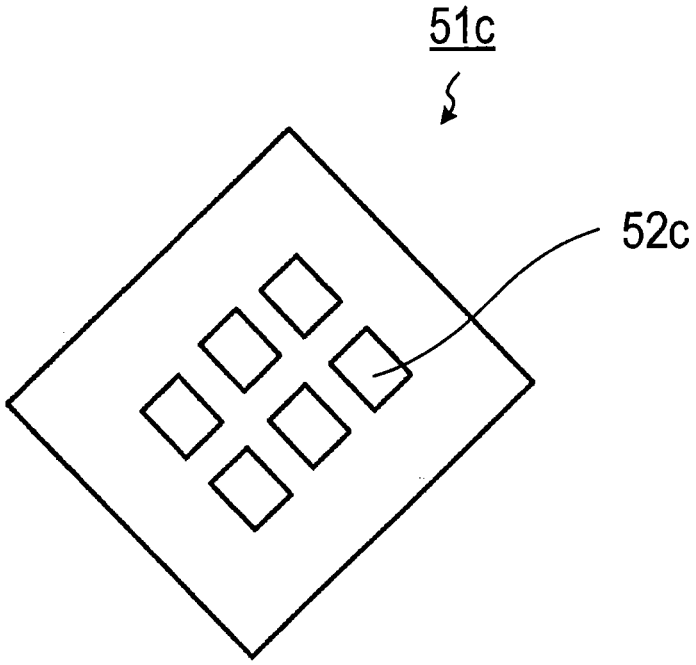
FIG. 17 is an explanatory view showing a variant of the conductor pattern.
Figure 18:
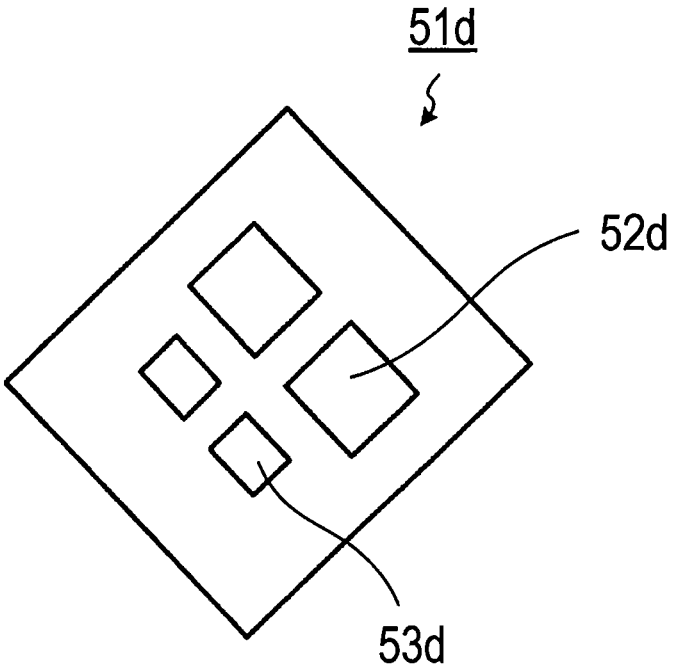
FIG. 18 is an explanatory view showing a variant of the conductor pattern.

(b) Each of the conductor patterns 51 is provided with four pattern-removed regions formed so as to have the same size in the above-described embodiment. However, the present disclosure is not limited to this. For example, the number of pattern-removed regions 52*c* may be either 6 or not less than or not more than 6, as in a conductor pattern shown in FIG. 17. Alternatively, pattern-removed regions 52*d*, 53*d* which are different in size may be combined, as in a conductor pattern 51*d* shown in FIG. 18.

Figure 19:
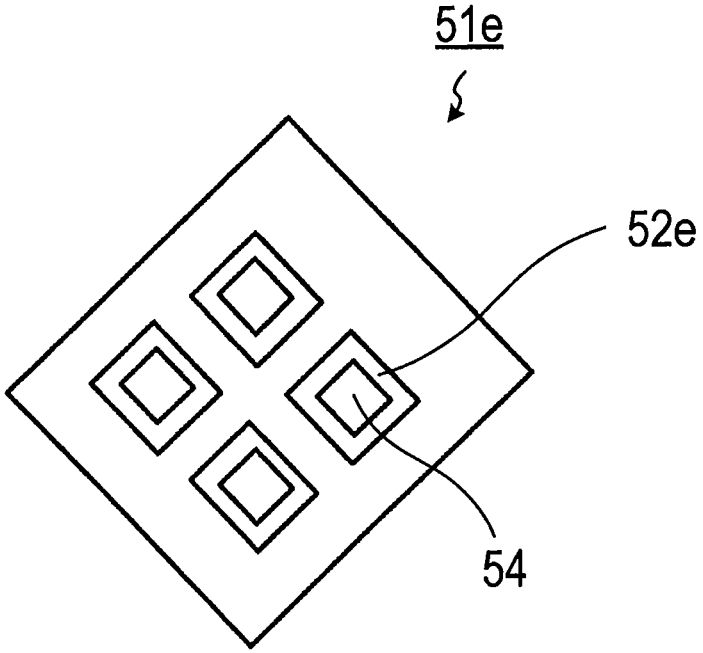
FIG. 19 is an explanatory view showing a variant of the conductor pattern.

(c) In the above-described embodiment, the pattern has been simply removed in the pattern-removed regions 52 of the conductor patterns 51. However, the present disclosure is not limited to this. For example, an internal pattern 54 which is electrically isolated from a conductor pattern 51*e* may be formed within each pattern-removed region 52*e*, as in a conductor pattern 51*e* shown in FIG. 19. In this case, the internal pattern 54 may have either a shape similar to that of the pattern-removed regions 52*e* or any other shape.

(d) In the above-described embodiment, the conductor patterns 51 are arranged so that the respective sides incline 45° to the x-axis. However, the present disclosure is not limited to this. For example, equivalent effects can be obtained if the respective sides incline within a range of about 45°±10°, i.e., about 35° to 55°.

(e) In the above-described embodiment, the outer shape of the conductor patterns 51 is rectangular. However, the present disclosure is not limited to this. The outer shape has only to be a shape which allows double resonance and enables adjustment of the resonance phase difference. For example, the outer shape of the conductor patterns may be a parallelogram shape. Alternatively, the outer shape of the conductor patterns may be formed according to a well-known pattern shape that generates circularly polarized waves and realized by adjusting the resonance phase difference to 180°, rather than 90°.

(f) In the above-described embodiment, the conductor patterns 51 are configured to emit emitted waves whose polarization direction is different by 90° from that of surface waves. However, the present disclosure is not limited to this. The polarization directions of the incident waves on the conductor patterns and the emitted waves from the conductor patterns should not be consistent in polarized wave. For example, the conductor patterns 51 may be configured so that the emitted waves are circularly polarized waves or elliptically polarized waves.

(g) In the above-described embodiment, the case where all the conductor patterns 51 belonging to the additional function part 5 have a specific shape having the pattern-removed regions 52 has been illustrated. However, a part of the conductor patterns belonging to the additional function part 5 may have a non-specific shape having no pattern-removed region 52.

(g) A plurality of functions of one constituent element in the above embodiment may be realized by a plurality of constituent elements, or one function of one constituent element may be realized by a plurality of constituent elements. In addition, a plurality of functions of a plurality of constituent element may be realized by one constituent element, or one function realized by a plurality of constituent elements may be realized by one constituent element. Moreover, a part of the components of the above-described embodiment may be omitted. Furthermore, at least a part of the components of the above-described embodiment may be added to or replaced with the components of another embodiment described above. Incidentally, all aspects included in the technical idea specified from the language described in the claims are embodiments of the present disclosure.

(h) In addition to the antenna device described above, the present disclosure can also be realized in various forms, such as a system including the antenna device as a component.

What is claimed is:

1. An antenna device comprising:

a dielectric substrate;

a base plate formed on a first surface of the dielectric substrate and configured to act as an antenna ground contact surface;

an antenna part formed on a second surface of the dielectric substrate and having one or more antenna patterns configured to act as radiating elements; and an additional function part having a plurality of conductor patterns, the conductor patterns being arranged around the antenna part and configured to resonate in one or more resonance directions in response to incident waves having an operating frequency of the antenna part, thereby generating emitted waves having polarized waves different from those of transmitted/received waves which are electromagnetic waves transmitted/received by the antenna part, wherein, for each of the resonance directions, at least one of the plurality of conductor patterns is formed in a specific shape which is provided with at least one line pattern having a width which is narrower than the total width of the conductor patterns in the direction perpendicular to the resonance direction.

2. The antenna device according to claim 1, wherein the conductor pattern formed in the specific shape has a shape such that two directions inclining to the polarization direction of the electromagnetic waves transmitted/received by the antenna part serve as the resonance directions, and that the phases of resonances in the two resonance directions are opposite to each other.

3. The antenna device according to claim 2, wherein the conductor pattern formed in the specific shape has a shape such that the two resonance directions of the resonances are perpendicular to each other.

4. The antenna device according to claim 2, wherein the conductor pattern formed in the specific shape is provided with one or more pattern-removed regions in which the pattern has been removed in a preset shape so that the line pattern is formed in a circumferential part of the pattern-removed regions.

5. The antenna device according to claim 4, wherein at least one of the one or more pattern-removed regions has a parallelogram shape formed in such a manner that all the four sides are located along either of the two resonance directions.

6. The antenna device according to claim 4, wherein at least one of the one or more pattern-removed regions has a triangular shape formed in such a manner that the two sides out of the three sides are located along either of the two resonance directions.

7. The antenna device according to claim 4, wherein at least one of the one or more pattern-removed regions has a circular shape.

8. The antenna device according to claim 4, wherein at least one of the one or more pattern-removed regions further comprises an internal pattern which is electrically isolated from the conductor patterns.

9. The antenna device according to claim 8, wherein the internal pattern has a shape similar to the outer shape of the pattern-removed regions.

* * * * *